US005111986A

United States Patent [19]

Niemann

[11] Patent Number: 5,111,986

[45] Date of Patent: May 12, 1992

[54] WEB-MOTION CONTROLLER

[75] Inventor: Heinrich Niemann, Enger, Fed. Rep. of Germany

[73] Assignee: Erhard & Leimer GmbH, Augsburg, Fed. Rep. of Germany

[21] Appl. No.: 613,474

[22] PCT Filed: Mar. 27, 1990

[86] PCT No.: PCT/DE90/00244

§ 371 Date: Oct. 25, 1990

§ 102(e) Date: Oct. 25, 1990

[87] PCT Pub. No.: WO90/11954

PCT Pub. Date: Oct. 18, 1990

[30] Foreign Application Priority Data

Apr. 1, 1989 [DE] Fed. Rep. of Germany ..... 3910548

[51] Int. Cl.[5] ..... B65H 23/028; B65H 23/14

[52] U.S. Cl. ..... 226/21; 242/75.51; 242/57.1

[58] Field of Search ..... 226/15, 16, 18, 19, 226/20, 21, 23, 3; 242/57.1, 75.43, 75.51-75.52

[56] References Cited

U.S. PATENT DOCUMENTS

| | | | |
|---|---|---|---|
| 3,652,001 | 3/1972 | Artelt, Jr. | 226/65 |
| 3,682,362 | 8/1972 | Ott, Jr. | 226/21 |
| 3,718,298 | 2/1973 | Lucas | 242/75.43 X |
| 3,966,105 | 6/1976 | Cluran | 226/21 |
| 4,204,619 | 5/1980 | Damour | 226/21 |
| 4,369,905 | 1/1983 | Tokuno | 226/45 X |
| 4,760,945 | 8/1988 | Zerle | 226/20 X |

FOREIGN PATENT DOCUMENTS

| | | |
|---|---|---|
| 3125852 | 1/1983 | Fed. Rep. of Germany . |
| 7533394 | 6/1977 | France . |

*Primary Examiner*—Daniel P. Stodola
*Assistant Examiner*—P. Bowen
*Attorney, Agent, or Firm*—Herbert Dubno

[57] ABSTRACT

The web-motion controller comprises a guide frame (4) with two guide rollers (2.1, 2.2). The lateral deviation of the web 91) downstream of the second guide roller (2,.2) is monitored by a position sensor (8), whose output signal is converted into control commands for a servomotor (7) turning the guide frame (4). In the guide frame (4), between the guide rollers (2.1, 2.2) a braking roller (11) is provided which is wrapped and entrained by the web and has a braking device (12). A force-measuring drum (14) finding out the web traction after the braking roller (11) in the travel direction of the web serves for producing measured-value signals, which control the braking device (12) via a control unit (13) with a selected value setting (19).

7 Claims, 3 Drawing Sheets

WEB-MOTION CONTROLLER

CROSS-REFERENCE TO RELATED APPLICATION

This application is a National Phase application of PCT/DE90/00244 filed Mar. 27, 1990 and based, in turn, on German National application P 39 10 548.2 filed Apr. 1, 1989.

FIELD OF THE INVENTION

The invention relates to a web-motion controller for the correction of lateral deviations of a running web from the preset position, with a guide frame and two axially parallel and spaced apart guide rollers supported therein, the web of material running between these rollers and being deflected on each of them by essentially 90° from the guide plane formed by the two guide rollers, and with a position sensor monitoring the lateral displacements of the web downstream of the second guide roller, the output signal of this sensor being translated into control commands for a servomotor pivoting the guide frame.

BACKGROUND OF THE INVENTION

Web-motion controllers of this kind are known for instance from DE 31 25 852 Cl or DE 35 35 011 C2 (U.S. Pat. No. 4,760,945).

OBJECTS OF THE INVENTION

It is the object of the invention to make possible a precise control of the web traction in the running web in a web-motion controller of this type, in addition to the correction of lateral displacements.

SUMMARY OF THE INVENTION

This problem is solved by providing a braking roller wrapped and entrained by the web of material, supported within the guide frame between the guide rollers, axially parallel to these rollers and outside their guide plane, which has a braking device actuated by a servo drive and a dynamometer monitoring the web traction downstream of the braking roller and producing measured-value signals which control the braking device via a control unit set to a preselected value. In a preferred embodiment, the dynamometer monitoring the web traction comprises a measuring drum supported between the braking roller and the second guide roller, axially parallel to both and also wrapped around by the web of material, with measured-value pickups for the forces exerted by the web on the measuring drum, as a result of web traction.

Depending on the actuation of the braking device, the braking roller exerts a smaller or bigger braking force upon the web of material wrapped around the braking roller and this way influences the web traction. The web traction is detected at the measuring drum and—via the control unit—serves again for the actuation of the braking device, so that a closed control circuit for the magnitude of the web traction is established. The desired traction of the web can be preselected through the set-value adjuster in the control unit. Since this regulation of the web traction requires only the winding of the web around the braking roller and the measuring drum, the web traction control according to the invention takes place in a manner which is very gentle to edges and surfaces, so that even sensitive webs of material can be controlled with the web-motion controller of the invention. By arranging the braking roller and the measuring drum within the guide frame itself, between the two guide rollers, no additional space is taken up by the web-traction controller. Thus, the guide frame of the invention which controls simultaneously the web motion as well as the web traction forms a compact mechanism with reduced space requirements. This is particularly important in cases where several overlaying webs of material have each to be regulated by a separate guide frame, as for instance in the case of corrugated cardboard, and where the guide frames have to cooperate so that a guiding of all webs of material can take place with edge precision according to a uniformly set position. As a result, it is possible to achieve a reproducible web traction control with precise regulation of the web motion, under conditions of reduced space and insuring gentle treatment for the web.

It is particularly advisable to set up the arrangement so that the measuring drum is elastically yieldably supported in a stress-measuring bearing transversally to the drum axis and in this direction the measured-value pickups detect the force exerted by the web traction on the axis of the measuring drum. Suitably, the measured-value pickups are wire strain gauges arranged on elastic support pieces of the measuring drum bearing.

Preferably, the measuring drum is supported in the guide plane of the two guide rollers Further, it is advantageous that the measuring drum be arranged next to the guide roller which comes first in the direction of the web travel, at a distance equaling the diameter of the braking roller, and this way the web of material wraps around the first guide roller and the braking roller by 180° each and around the measuring drum by 90°. Due to the fact that the braking roller is wrapped about by 180° by the web, optimal braking forces are exerted by the braking roller upon the web, whereby of course the possibility exists to make the braking roller with a considerably larger diameter than the two guide rollers or the measuring drum, in order to obtain this way a braking surface as large as possible, wherein the web is in contact with the braking roller.

It has also been found to be advantageous that the braking device of the braking roller consist of a pneumatically actuatable disk brake and that the control unit be equipped with a signal converter for the conversion of electrical control signals into pneumatic control signals.

BRIEF DESCRIPTION OF THE DRAWING

These and other features, objects and advantages of my invention will be more readily apparent from the following description, reference being made to the accompanying drawing in which.

SPECIFIC DESCRIPTION

Figure 1:
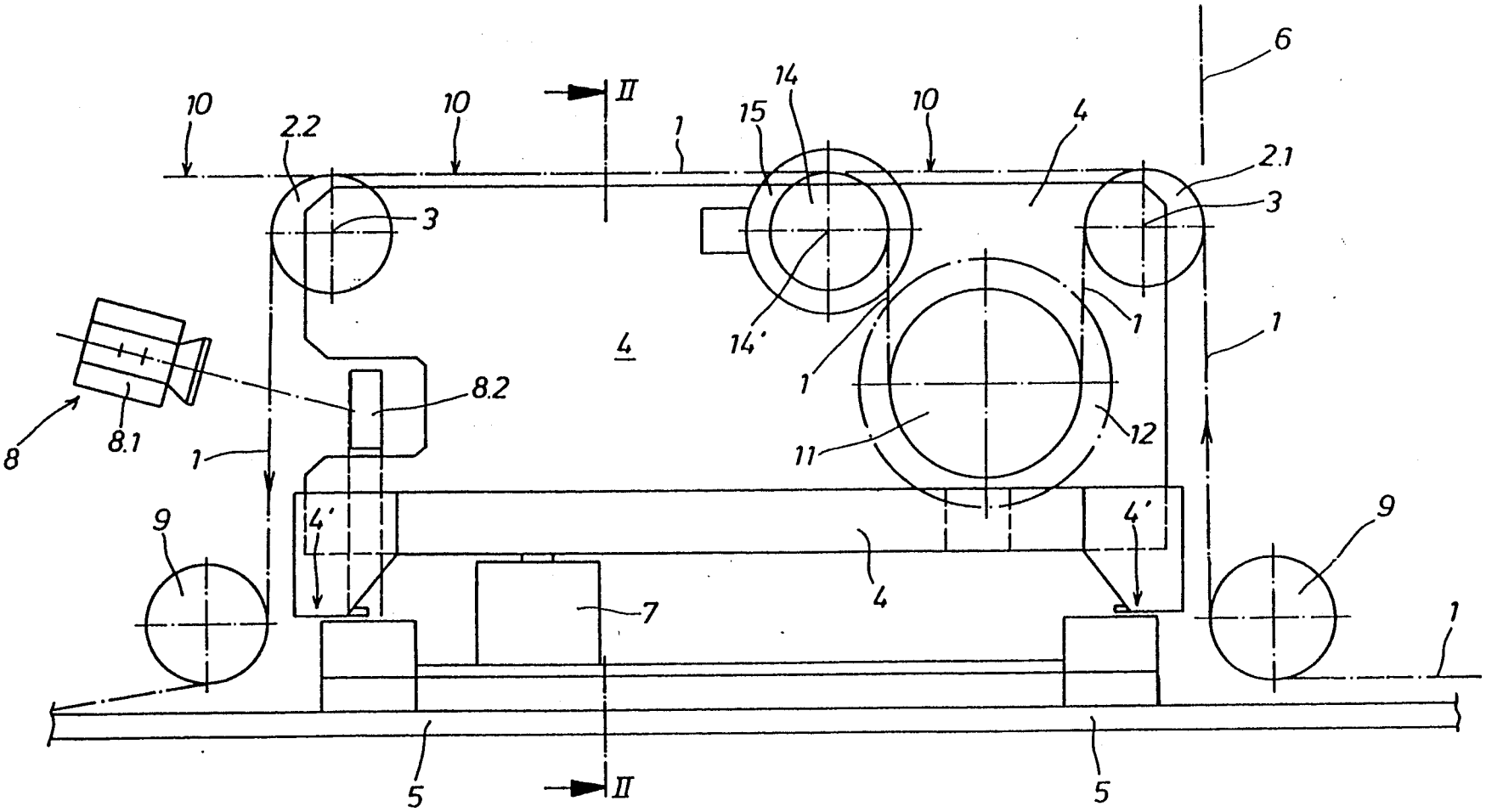
FIG. 1 a web-motion controller according to the invention, in a schematic lateral view.
Figure 2:
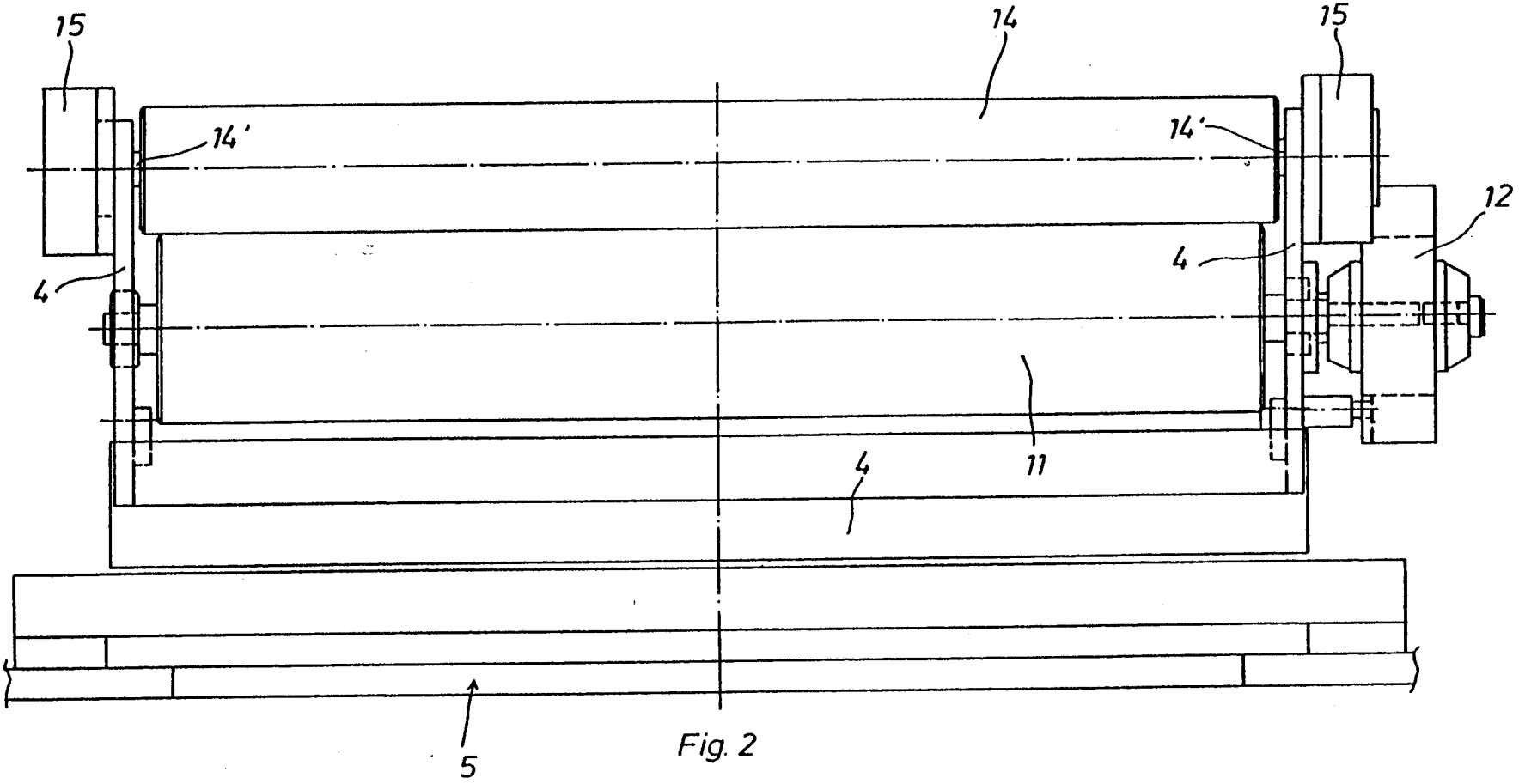
FIG. 2 is the section of the web-aligning apparatus along lines II—II in FIG. 1.
Figure 3:
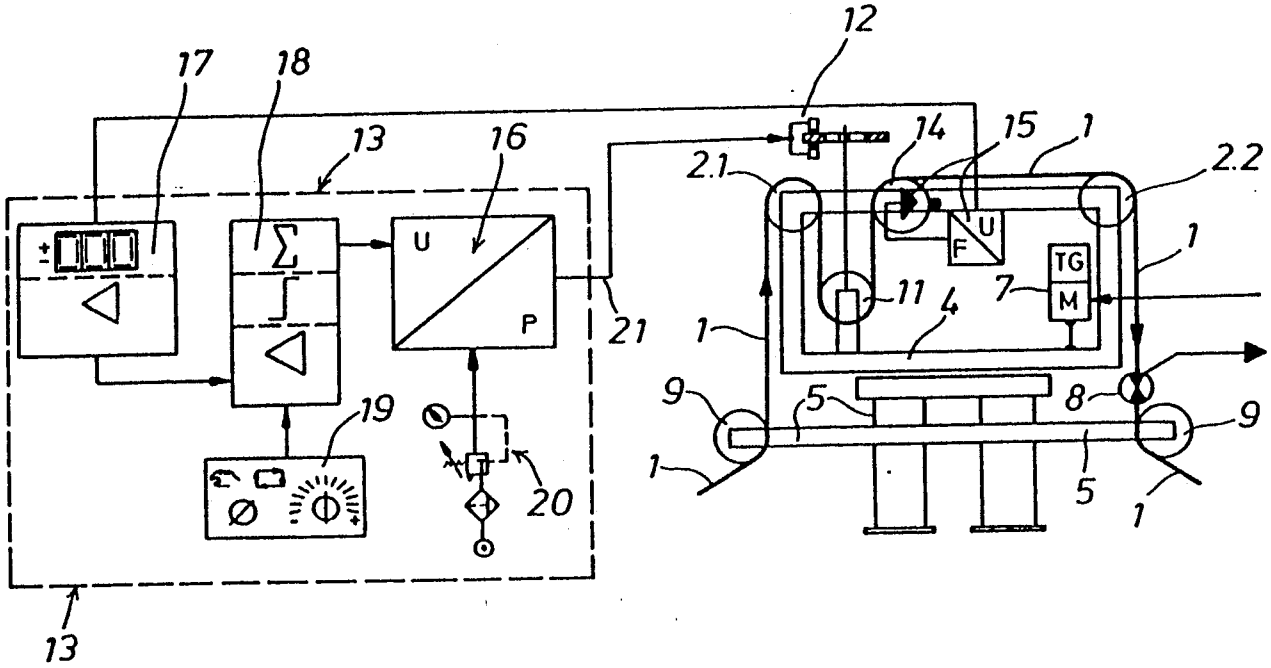
FIG. 3 is a diagram of the control circuit serving for the control of the web traction by the web-motion controller according to FIGS. 1 and 2.

The web-motion controller represented in the drawing for a web of material generally marked 1 has guide rollers 2.1, 2.2. freely rotatable around parallel axes 3, with the web running over their shell surfaces. The guide rollers are arranged in a guide frame 4, which is supported on a fixed stand and pivotable about a theoretical axis 6 by means of a servomotor 7. The servomotor 7 is controlled in response to the lateral web displacement downstream of the second roller 2.2 in the guide frame 4, by means of the position sensor 8 reacting to the lateral course of the web edge or to a guideline on the web. The sensor can be a photo-electric sensor consisting of an infrared emitter 8.1 and an infrared receiver 8.2. The support of the guide frame 4 on the fixed stand 5 is achieved by means of side bearings 4', which are not shown in detail, of the type described for instance in DE 31 25 852 Cl. In front of and after the first, respectively the last guide roller 2.1, 2.2. of the guide frame 4, at least one further deflection roller 9 with fixed axis of rotation is provided for each. Thus, the deflection rollers 9 do not participate in the adjustment motions of the guide frame 4. They redirect the web 1 over the guide rollers 2.1, 2.2 of the guide frame 4 in a direction which is perpendicular to the guiding plane 10 between the two guide rollers. The signals emitted by the position sensor 8 are converted in control commands for the servomotor 7 of the guide frame 4, in a known manner, which here is not further described and explained. If the position sensor 8 registers a lateral deviation of the web 1, the guide frame 4 is pivoted by the servomotor 7 so that the second guide roller 2.2 is slightly swung in the opposite direction, returning the web to its initially set position between the second guide roller 2.2 and the following deflection roller 9.

For the control of the web traction, in the guide frame 4, between the guide rollers 2.1, 2.2 a braking roller 11 is provided which is axially parallel with the guide rollers and located outside their guiding plane 10. The web winds about and entrains this braking roller. The braking roller 11 has a braking device 12 actuated by a servo drive, so that depending on the brake torque exerted by the braking device 12 upon the braking roller 11, the web traction in the web 1 entraining the braking roller 11 can be influenced. In the travel direction of web 1, behind the braking roller 11, there is a dynamometer measuring the web traction, whose measured-value signals control the servo drive of the braking device 12 via a control unit 13 with preselected value setting. This force-measuring arrangement consists of a measuring drum 14 which is supported in guide frame 4 along the course of the web 1 between the braking roller 11 and the second guide roller 2.2 axially parallel to both of them and wrapped about by the web 1, having measured-value pickups for the forces exerted by the web upon the measuring drum resulting from the traction of the web. For this purpose, in the embodiment example the measuring drum 14 is elastically yieldably supported in force-measuring bearings 15, transversally with respect to the drum axis 14'. In the direction of this yieldability, the measured-value sensors pick up the forces resulting at the measuring drum axis 14' from the web traction. The measured-value pickups can be for instance wire strain gauges arranged on elastic support pieces of the measuring drum bearing, which in the drawing are not shown in detail.

The measuring drum 14 is supported in the guiding plane 10 of the two guide rollers 2.1, 2.2. The diameter of the braking roller 11 has a larger diameter than the guide rollers 2.1, 2.2 and the measuring drum 14. The measuring drum 14 is arranged next to the first guide roller 2.1 considered in the direction of the web travel, at a distance equal to the diameter of the braking roller 11. As a result, the web is wrapped around both the first guide roller 2.1 and the braking roller 11 by 180° and wrapped around the measuring drum 14 over 90°. The braking device 12 of the braking roller 11 can consist of a pneumatically actuated disk brake. In this case the control unit 13 has a signal converter 16 for the conversion of electric signals into pneumatic control signals.

The measured-value signals of the measured-value pickup 15 are fed to a signal amplifier 17 with digital indicator, to which a control unit 18 subordinated to selected-value setter 19 is connected. The control unit 18 comprises amplifying, summing and delay components and acts with its output upon the signal converter 16, which is connected with its pneumatic segment to a pneumatic supply unit 20 and with its output 21 to the pneumatically actuated disk brake 12.

I claim:

1. A device for controlling and aligning of a web of material travelling along a path, said device comprising;

a guide frame pivotable about a frame axis;

first and second spaced apart guide rollers mounted on said frame and rotatable about respective parallel coplanar roller axes lying in a plane and perpendicular to said frame axis, the web passing over said guide rollers parallel to said plane over a stretch;

deflecting means for deflecting said web at a right angle from said stretch along said path at each end of said stretch;

actuating means including a servomotor for pivoting said frame about said frame axis;

a position sensor operatively connected with said actuating means and downstream of said second roller for controlling lateral deviations of the web and forming an output signal corresponding to an actual position thereof for controlling said servomotor to pivot said frame in response to said outputs signal;

a braking roller on said frame between said guide rollers rotatable about a respective axis parallel to said roller axis but offset therefrom, said braking roller being wrapped by said web and said web entraining said braking roller in rotation;

a braking device operatively connected with said braking roller for exerting a brake torque thereupon, so that a web traction in a direction of the travel of the web produced by said braking roller is modified;

a servo drive on said frame operatively connected with said braking device for actuating same; and stress-measuring means for controlling said web traction, said stress-measuring means being provided with:

means for generating a measured-value signal corresponding to the web traction in said travel direction, and a control unit having a preselected value signal and operatively connected with said servo drive of the braking device for controlling said drive in response to a controlling signal resulted upon comparing of said measured-value and preselected value signals.

2. The device defined in claim 1 wherein the force-measuring means further comprises a measuring drum supported within the guide frame along the path of said web, between the braking roller and the second guide roller axially parallel with said guide rollers and having measured-valued pickups for the forces exerted by the web of material upon the measuring drum due to web traction.

3. The device defined in claim 2 wherein the measuring drum is elastically yieldably supported in a force-measuring bearing transversely to the drum axis and in this direction the measured-value pickups receive the forces resulting at the measuring drum from the web traction along said stretch between said guide rollers.

4. The device defined in claim 3 wherein the measured-value pickups are wire strain gauges arranged on elastic support pieces of the measuring drum bearing.

5. The device defined in claim 3 wherein the measuring drum has a respective axis coplanar with said roller axes of said guide rollers.

6. The device defined in claim 2 wherein the measuring drum is arranged downstream of said first guide roller along said stretch and spaced therefrom at a distance equal to a roller diameter of the braking roller the web of material wrapping around both the first guide roller and the braking roller by 180° and around the measuring drum by 90°.

7. The device defined in claim 1 wherein said braking device of the braking roller consists of a pneumatically actuated disk brake, the control unit being provided with a signal converter for the conversion of electrical control signals into pneumatic control signals.

* * * * *